US005616337A

United States Patent [19]

Kasianovitz et al.

[11] Patent Number: 5,616,337

[45] Date of Patent: Apr. 1, 1997

[54] UNIT DOSE SKIN CARE PACKAGE

[75] Inventors: Elizabeth J. M. Kasianovitz, San Diego; Lisa A. Bellm, Beverly Hills; Kameron W. Maxwell, Calma, all of Calif.

[73] Assignee: Genta Incorporated, San Diego, Calif.

[21] Appl. No.: 380,740

[22] Filed: Jan. 30, 1995

[51] Int. Cl.[6] ..... A01N 25/34; B65D 25/08

[52] U.S. Cl. ..... 424/414; 424/404; 206/219; 206/221; 206/229; 206/494; 206/568; 206/812

[58] Field of Search ..... 424/400, 401, 424/404, 414; 206/219, 221, 229, 494, 568, 812

[56] References Cited

U.S. PATENT DOCUMENTS

| | | | |
|---|---|---|---|
| 4,591,357 | 5/1986 | Sneider | 604/416 |
| 4,771,919 | 9/1988 | Ernst | 222/134 |
| 4,881,278 | 11/1989 | Farah | 206/812 |
| 4,989,758 | 2/1991 | Keller | 222/137 |
| 5,033,650 | 7/1991 | Colin | 222/137 |
| 5,154,321 | 10/1992 | Shomer | 222/145 |
| 5,167,347 | 12/1992 | Weigner et al. | 222/94 |
| 5,207,320 | 5/1993 | Allen | 206/220 |
| 5,287,961 | 2/1994 | Herran | 206/219 |

FOREIGN PATENT DOCUMENTS 1054170 10/1953 France .

OTHER PUBLICATIONS

Janice M. Horowitz, Compatible Drugs, Reporter May 1994, p. 76.

Photocopy PROCOR Technologies PRO–IMMUNE 99 Product.

*Primary Examiner*—Carlos Azpuru

*Attorney, Agent, or Firm*—Lyon & Lyon

[57] ABSTRACT

A unit dose package has two chambers separated by a frangible seal. A liquid or solvent is provided in one of the chambers. An absorptive pad and powder are provided in the other chamber. The liquid and powder are stored separately, to avoid decomposition of the unstable mixture. In use, the first chamber is squeezed or rolled, bursting the seal, and driving the liquid into the second chamber, where it dissolves the powder and is absorbed by the pad. The package is peeled or torn open, and the pad is removed and applied to the skin.

13 Claims, 1 Drawing Sheet

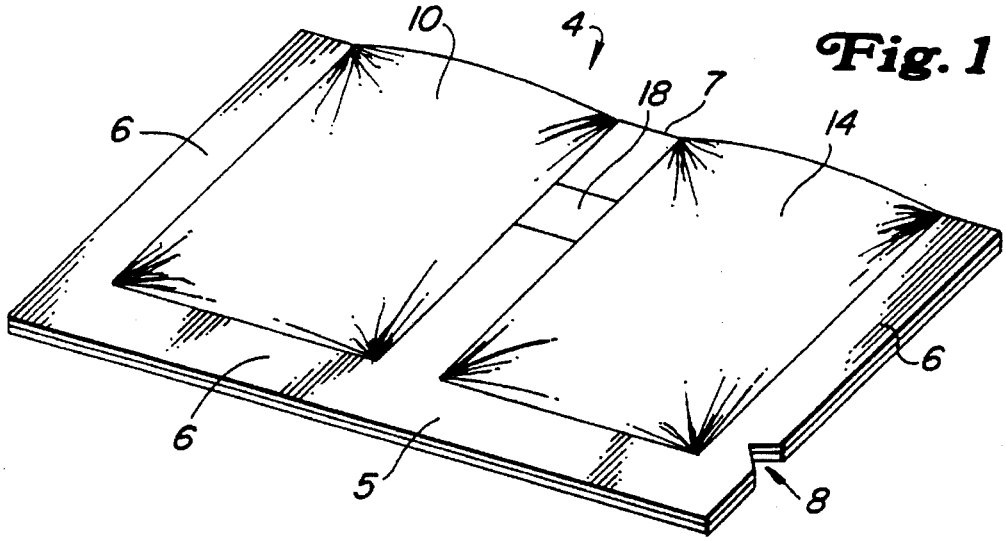
Fig. 1
Fig. 2
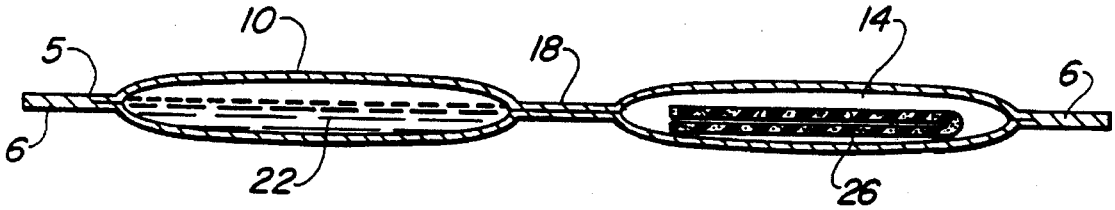

UNIT DOSE SKIN CARE PACKAGE

BACKGROUND OF THE INVENTION

This invention relates to a unit dose package. More specifically, the invention finds applications in containing and applying skin care drugs and products.

It is often advantageous to store two different substances, e.g., drugs and cosmetics, separately, and mix them together just prior to use. If mixed first, many substances will decompose and lose their effectiveness before they can be used. Similarly, other substances, which must be combined before use, such as a powdered drug and solution or solvent vehicle, become unstable when combined. These substances must be used very soon after they are combined to achieve the desired therapeutic effect.

Several known packages use a multi-chamber system for the mixing of separated substances, for example, the mixing of two liquids. These devices range from containers that aid in mixing separated components to devices that allow the simultaneous delivery of several separated substances. However, while these known packages or devices may facilitate mixing of liquids and powders just prior to use, disadvantages remain in applying the mixture from the package. Accordingly, it is an object of the invention to provide an improved unit dose package.

SUMMARY OF THE INVENTION

To these ends, a unit dose package is preferably formed from a web or foil-like material. The web is separated into two compartments divided by a frangible seal. The first compartment or chamber of the web contains a liquid. The second compartment contains an applicator or pad and a drug preferably in the form of a powder.

The package may be used with an anti-acne product. In this embodiment the liquid and powder are medications that treat acne. The applicator is preferably a pad or towlette capable of absorbing the liquid contained in the other compartment. The package is particularly useful when the liquid and powder are chemically unstable when combined. The liquid and the pad, with or without a powdered drug, or a second liquid, remain separate until the product is to be used. The freshness and chemical stability of the product may be improved with this delivery system and application of the product is simplified.

BRIEF DESCRIPTION OF THE DRAWINGS

FIG. 1 is a perspective view of the present unit dose package; and

FIG. 2 is a cross section of the package of FIG. 1.

DETAILED DESCRIPTION OF THE PREFERRED EMBODIMENT

As shown in FIGS. 1 and 2, a web or foil material 5 is folded over once at a fold line 7. A seal flange 6 surrounds three borders of the web 5, but not the fold line 7. A frangible or burstible seal 18 separates the web into two compartments 10 and 14. The first compartment 10 contains a liquid 22. The second compartment 14 contains an applicator or pad 26, and a powdered drug. The powdered drug may be on or in the pad, or loose in the second compartment. A peel or tear notch 8 is located near the second compartment 14. Once formed, the compartments are sealed from the outside.

In use, the first compartment 10 is preferably rolled toward the frangible seal 18 (like a tube of toothpaste), causing the middle seal 18 to burst. The liquid 22 then flows into the second compartment 14 through a narrow channel formed by the burst seal 18. The second compartment 14 containing the pad with the active powder material is then manipulated with the fingers until the liquid dissolves the powder and is absorbed into the pad 26. The package is then torn open at the tear knotch 8 and the saturated pad is applied or wiped over the area to be treated. The pad and package are disposable. The applicator or pad is advantageously an absorptive pad, such as rayon, polypropylene or cotton.

For the treatment of acne, the powder may be an acne medicine including a salt of erythromycin (such as ACT-AGEN™) and the fluid is preferably an alcohol solution.

In another embodiment, the liquid is medicinally active. For example, the liquid may comprise a skin moisturizing lotion, a nail polish removing solution such as toluene, an anti-biotic topical solution, asteroid solution, or an antihistamine solution. The package may be used with different liquids or powders in the first and second compartments, with a pad in one or both compartments.

In a method of making the present package, an unprinted web or foil, in a width of preferably about 3.5 inches is placed on a horizontal form fill and seal machine. The web is drawn through a set of seal bars that form the outside weld-seals 6 and the middle frangible seal 18. The frangible seal is achieved by the sealant layer receiving a precise amount of heat for a set period of time by the heat seal bars. The weld-seals are also achieved through heat and dwell time.

After the sides are "welded" and the frangible seals are in place, two compartments have been formed. The package travels to the next station where a towlette or absorptive pad is inserted in one of the empty compartments. The package moves on to the next fill station where a powder charge, which in certain embodiments is an active drug, is optionally placed into the compartment with the towlette. At the same time, a liquid is released into the empty compartment next to the towlette. The package moves down to the next station where the top seal is made, again using heat and pressure. The package moves to the next station where it is slit into a single two-compartment unit dose package with one compartment having a towlette, and the other compartment having a liquid. The packages are then counted and boxed for shipment. Formation of the web, compartments, seal flanges and burstible seals is well known in the art.

Thus, while several embodiments have been shown and described, it will be apparent to those skilled in the art that many other modifications may be made, without departing from the spirit and scope of the invention.

We claim:

1. A unit dose package comprising:

a web having two compartments separated by a frangible seal;

a liquid contained within the first compartment; and an applicator contained within the second compartment and separate from the web.

2. The package of claim 1 further comprising a powder on or in the applicator.

3. The package of claim 1 wherein the applicator is an absorptive pad.

4. The package of claim 2 wherein the liquid and powder comprise an anti-acne medicine.

5. The package of claim 1 wherein the web comprises a foil material.

6. The package of claim 1 wherein the applicator is a towelette.

7. The package of claim 1 wherein the compartments are weld-sealed.

8. A dual compartment package for containing two substances separately until they are to be used, comprising:

a foil web forming a first compartment and a second compartment;

a burstible seal separating the first compartment and the second compartment;

a liquid contained in the first compartment; and a powder on or in an applicator contained in the second compartment, with the applicator removable from the second compartment.

9. The package of claim 8 wherein the powder includes an erythromycin salt.

10. The package of claim 8 wherein the liquid is an alcohol solution.

11. The package of claim 8 wherein the applicator is a folded towlette.

12. The package of claim 8 further comprising a tear notch in the foil web and adjacent the second compartment.

13. A method of applying an unstable topical skin treatment comprising the steps of:

pressuring a liquid in a first compartment sufficiently to burst a center seal;

allowing the liquid to flow from the first compartment, through the bursted seal, into a second compartment;

absorbing the liquid into an applicator with an active powder substance in the second compartment;

opening the package by pulling at a tear notch on the second compartment; and removing the applicator from the second compartment.

* * * * *